US007344407B1

(12) United States Patent
Chen et al.

(10) Patent No.: US 7,344,407 B1
(45) Date of Patent: Mar. 18, 2008

(54) COMPUTER PANEL WITH CONNECTOR ASSEMBLY

(75) Inventors: Yun-Lung Chen, Taipei Hsien (TW); Qing-Hao Wu, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 11/753,582

(22) Filed: May 25, 2007

(30) Foreign Application Priority Data

Dec. 8, 2006 (CN) ..... 2006 2 0016243 U

(51) Int. Cl.
*H01R 13/60* (2006.01)

(52) U.S. Cl. ..... 439/540.1; 439/553

(58) Field of Classification Search ..... 439/540.1, 439/549, 552, 553, 557, 565
See application file for complete search history.

(56) References Cited

U.S. PATENT DOCUMENTS 5,836,786 A * 11/1998 Pepe ..... 439/557
6,238,243 B1 * 5/2001 Lorenz et al. ..... 439/553
7,118,414 B2 * 10/2006 Spears et al. ..... 439/540.1
2005/0164548 A1 7/2005 Spears et al.

* cited by examiner

*Primary Examiner*—Tho D. Ta
(74) *Attorney, Agent, or Firm*—Frank R. Niranjan

(57) ABSTRACT

A computer panel with a connector assembly, includes a panel, a connector, and a receiving bracket for fittingly receiving the connector. The panel defines an opening and a slot at one side of the opening. The connector includes a pair of annular securing members respectively extending from two opposite sides thereof. The receiving bracket includes a pair of sidewalls respectively abutting against the two opposite sides of the connector, and a bottom wall supporting the connector thereon. An elastic hook protrudes from each sidewall for respectively engaging with the securing members. A blocking tab extends from a bottom wall of the receiving bracket in a direction parallel to the panel. The panel defines a slot. The blocking tab of the receiving bracket is inserted in the slot and blocked by an inner side of the panel. A fastening member secures the receiving bracket to the panel.

16 Claims, 3 Drawing Sheets

COMPUTER PANEL WITH CONNECTOR ASSEMBLY

BACKGROUND OF THE INVENTION

1. Field of the Invention

The present invention relates to computer panels, particularly to a computer panel with a connector assembly.

2. Description of Related Art

Input/output connectors are usually used in a personal computer for allowing audio, visual, network, phone, modem and other input/output connections to be made to the computer. The input connections for a personal computer often involve input ports for a keyboard, mouse, microphone, video feed and, more recently, multi-use universal serial bus (USB) connectors. The output connections for a personal computer often involve output ports for a printer, video monitor, modem, and audio loudspeakers. Typically, a connector involving the preceding input/output ports is secured to a bracket by bolts. Then, the bracket is fixed to a computer panel also by bolts or screws. This method involves too many fasteners and adds to cost of labor in manufacturing.

What is needed, therefore, is a computer panel with a connector assembly which allows connector ports to be easily connected to the computer.

SUMMARY OF THE INVENTION

A computer panel with a connector assembly, includes a panel, a connector, and a receiving bracket for fittingly receiving the connector. The panel defines an opening and a slot at one side of the opening. The connector includes a pair of annular securing members respectively extending from two opposite sides thereof. The receiving bracket includes a pair of sidewalls respectively abutting against the two opposite sides of the connector, and a bottom wall supporting the connector thereon. An elastic hook protrudes from each sidewall for respectively engaging with the securing members. A blocking tab extends from a bottom wall of the receiving bracket in a direction parallel to the panel. The panel defines a slot. The blocking tab of the receiving bracket is inserted in the slot and blocked by an inner side of the panel. A fastening member secures the receiving bracket to the panel.

Other advantages and novel features of the present invention will become more apparent from the following detailed description of preferred embodiment when taken in conjunction with the accompanying drawings, in which:

DETAILED DESCRIPTION OF THE INVENTION

Figure 1:
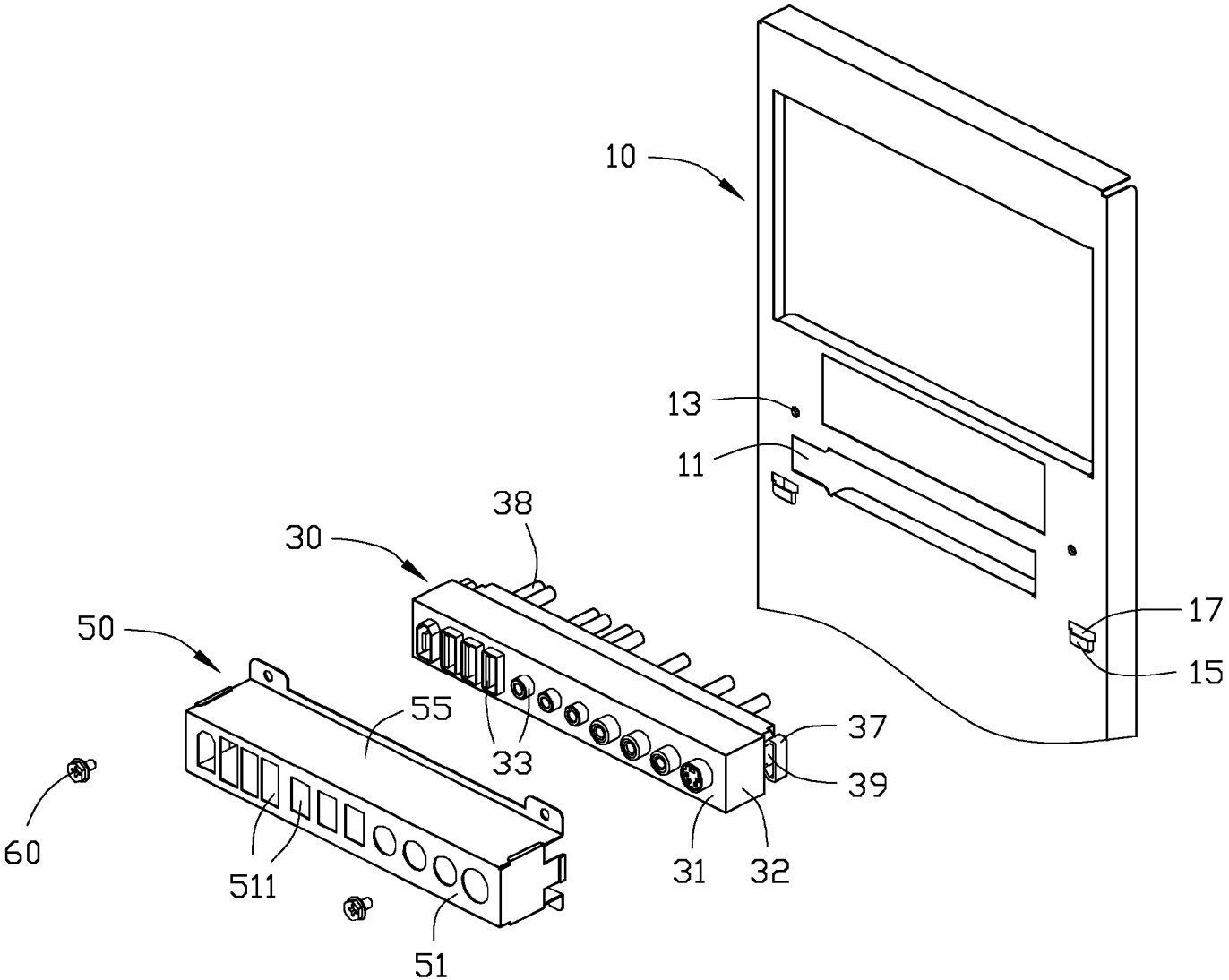
FIG. 1 is an exploded, isometric view of a computer panel with a connector assembly in accordance with a preferred embodiment.
Figure 2:
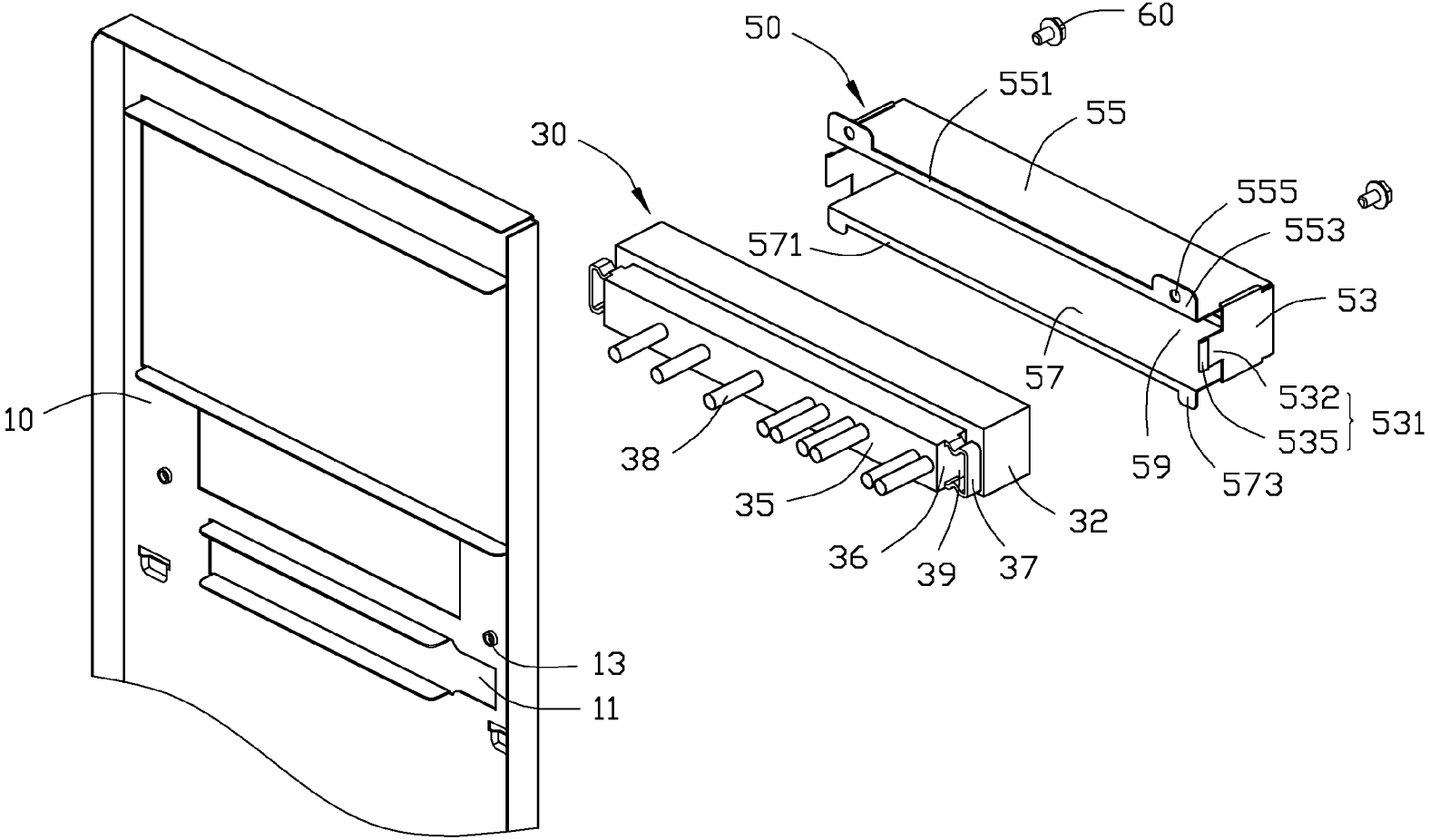
FIG. 2 is similar to FIG. 1, but viewed from another aspect.

Referring to FIGS. 1 and 2, a computer panel with a connector assembly in accordance with a preferred embodiment for a peripheral device conveniently connected thereto, includes a rectangular panel 10, a connector 30, and a bracket 50 mounted to the panel 10 for receiving the connector 30.

An opening 11 is defined in a middle of the panel 10, for providing a path for cables 38 of the connector 30 to extend therethrough and connect to a computer. A pair of securing holes 13 is respectively defined in two sides of the panel 10 higher up than the opening 11. A pair of arches 15 is stamped out from the panel 10. A slot 17 is defined between an edge of each arch 15 and the panel 10.

The connector 30 includes a first rectangular base and a similar smaller second rectangular base connected in parallel. The first rectangular base includes a long side 31 parallel to the panel 10 and a pair of opposite short sides 32 perpendicular to the long side 31. A plurality of connector ports 33, such as USB ports, audio ports, video ports etc., protrudes out from the long side 31 of the first rectangular base. The second rectangular base includes a long side 35 also parallel to the panel 10 and a pair of opposite short sides 36 perpendicular to the long side 35. The long side 35 of the second rectangular base is shorter than the long side 31 of the first rectangular base. A plurality of cables 38 for connecting to the computer extends from the long side 35 of the second rectangular base. An annular securing member 37 protrudes from each short side 36 of the second rectangular base in a direction along the long side 35 thereof. A securing slot 39 is defined between each securing member 37 and each corresponding short side 36 of the second rectangular base. Each securing member 37 extends beyond the corresponding short side 32 of the first rectangular base, thereby defining a gap between an inner surface of the securing member 37 and the short side 32 in a direction perpendicular to the short side 32.

The receiving bracket 50 includes a front wall 51 corresponding to the long side 31 of the first rectangular base. A plurality of holes 511 is defined in the front wall 51 for the connector ports 33 of the connector 30 extending through. The receiving bracket 50 further includes a top wall 55 and a bottom wall 57 perpendicular to the front wall 51, and a pair of sidewalls 53 perpendicularly connected to the front wall 51, the top wall 55, and the bottom wall 57. The front wall 51, top wall 55, bottom wall 57, and the pair of sidewalls 53 together define a receiving housing 59 corresponding to the first rectangular base of the connector 30. A flange 551 parallel to the panel 10 extends up from an edge of the top wall 55. A pair of securing tabs 553 each with a securing hole 555 defined therein respectively protrudes from two sides of the flange 551. A flange 571 parallel to the panel 10 extends down from an edge of the bottom wall 57. A pair of blocking tabs 573 respectively protrudes down from two sides of the flange 571. An elastic hook 531 extends backward from a rear edge of each sidewall 53. Each hook 531 includes a cantilever 532 protruding from a center portion of the rear edge of the corresponding sidewall 53 and a clasp 535 bent out from a distal end of the cantilever 532. The thicknesses of the clasps 535 are greater than the gaps between the short sides 32 of the first rectangular base and the securing member 37 of the second rectangular base.

Figure 3:
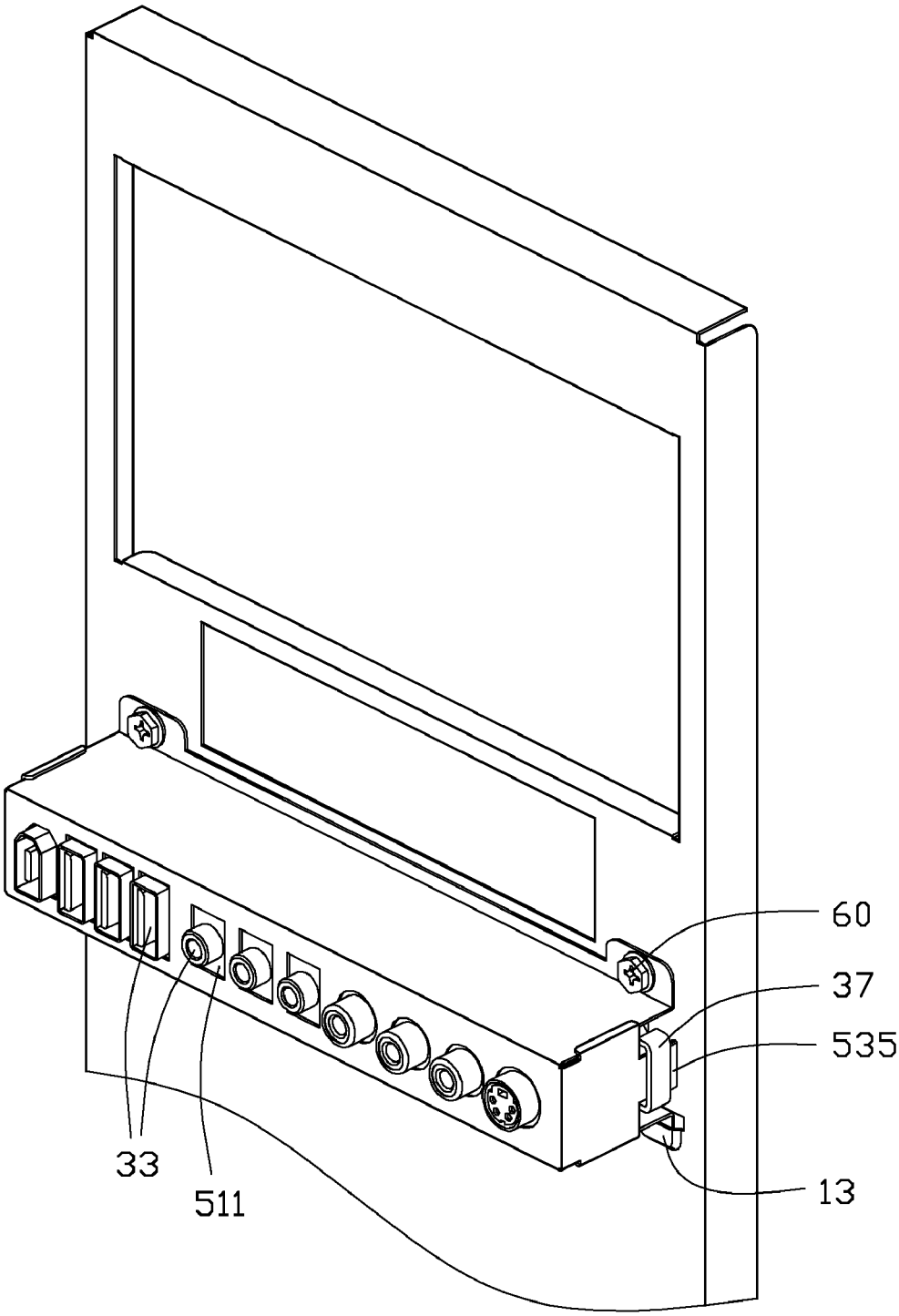
FIG. 3 is an assembled view of the computer panel of FIG. 1.

Referring also to FIG. 3, in assembly, the first rectangular base of the connector 30 slides into the receiving housing 59 of the receiving bracket 50 along the top wall 55 and bottom wall 57 thereof. The sidewalls 53 of the receiving bracket 50 abut against the short sides 32 of the first rectangular base. The clasps 535 of the elastic hooks 531 extend into the corresponding securing slots 39 of the securing members 37. The clasps 535 are depressed by the inner surface of the securing members 37 to force the cantilevers 532 of the hooks 531 to distort toward the short side 36 of the second rectangular base. When the clasps 535 of the hooks 531 extend through the corresponding securing slots 39 of the securing members 37, the elastic hooks 351 rebound back to their initial state. Each clasp 535 is blocked by an edge of the securing member 37 facing the panel 10, for preventing the connector 30 retracting from the receiving bracket 50. Thus, the connector 30 is secured into the receiving bracket 50 in a direction perpendicular to the panel 10 thereby forming a connector assembly. The connector ports 33 of the connector 30 extend through the corresponding holes 511 to be exposed out of the front wall 51 of the receiving bracket 50. Then, the blocking tabs 573 of the receiving bracket 50 are inserted in the slots 17 of the panel 10. The blocking tabs 573 sit on the arches 15 and are blocked by inner sides of the arches 15. The securing holes 555 of the securing tabs 553 of the receiving bracket 50 are aligned with the securing holes 13 of the panel 10. A pair of fastening members 60 passes through the securing holes 555 and 13 for fixedly securing the receiving bracket 50 to the panel 10. The cables of the connector 30 extend through the opening 11 of the panel 10 for connecting with the computer.

In disassembly, the fastening members 60 are released and the blocking tabs 573 are removed from the arches 15 to detach the connector assembly from the panel 10. Then, the clasps 535 of the elastic hooks 531 of the receiving member 50 are depressed toward the short sides 36 of the second rectangular base of the connector 30 and moved away from the securing members 37. When the clasps 535 of the hooks 631 disengage from the edges of the securing members 37, the connector 30 can be removed from the receiving bracket 50 for replacement.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A computer panel with a connector assembly, comprising:

a panel defining an opening and at least one slot at one side of the opening;

a connector comprising a pair of annular securing members respectively extending from two opposite sides thereof; and a receiving bracket configured for attaching the connector to the opening of the panel, the receiving bracket defining a receiving housing fittingly receiving the connector therein, the receiving bracket comprising a pair of sidewalls respectively abutting against the two sides of the connector, and a bottom wall supporting the connector thereon, an elastic hook protruding from each of the sidewalls for engaging with the securing member, at least one blocking tab extending from the bottom wall of the receiving bracket in a direction parallel to the panel, the blocking tab of the receiving bracket being inserted in the slot and blocked by an inner side of the panel, at least one fastening member securing the receiving bracket on the panel.

2. The computer panel as described in claim 1, wherein the receiving bracket further comprises a top wall opposite to the bottom wall, at least one securing tab defining a securing hole therein extends from the top wall in a direction parallel to the panel, a securing hole corresponding to the securing hole of the receiving bracket is defined in the panel, and the fastener passes through the securing holes to secure the receiving bracket to the panel base.

3. The computer panel as described in claim 1, wherein the connector comprises a big first rectangular base and a small second rectangular base connected in parallel, the second base is inserted into the opening and comprises a pair of longitudinal sides and a pair of lateral sides, the annular securing members extend from the lateral sides of the second rectangular base along a longitudinal direction of the second base.

4. The computer panel as described in claim 3, wherein the annular securing members respectively exceed two lateral sides of the first rectangular base.

5. The computer panel as described in claim 4, wherein a securing slot is defined between each securing member and the corresponding lateral side of the connector, each elastic hook comprises a cantilever extending the corresponding sidewall and a clasp bent from a distal end of the cantilever, the clasp extends through the corresponding securing slot of the securing member in a direction perpendicular to the panel and engages with an edge of the securing member facing the panel, for securing the connector in the receiving bracket.

6. The computer panel as described in claim 5, wherein at least one arch protrudes from the panel, the slot of the panel is defined by an edge of the arch and the panel, the blocking tab is inserted in the slot and sitting on the edge of the arch.

7. A computer panel with a connector assembly, comprising:

a panel, at least one arch protruding from the panel, a slot being defined by an edge of the arch and the panel;

a connector comprising a pair of annular securing members respectively extending from two opposite sides of the connector; and a receiving bracket defining a receiving housing for fittingly receiving the connector therein, the receiving bracket comprising a pair of sidewalls each with an elastic hook protruding therefrom, for engaging with the securing members to secure the connector in the receiving bracket in a direction perpendicular to the panel, at least one blocking tab extending from a bottom wall of the receiving bracket;

wherein the blocking tab of the receiving bracket is engaged in the slot of the panel in a direction parallel to the panel and blocked by an inner side of the panel.

8. The computer panel as described in claim 7, wherein at least one securing tab defining a securing hole extends from a top wall opposite to the bottom wall of the receiving bracket in a direction parallel to the panel, a securing hole corresponding to the securing hole of the receiving bracket is defined in the panel, and the securing means passes through the securing holes to secure the receiving bracket to the panel.

9. The computer panel as described in claim 7, wherein the connector comprises a first rectangular base and a smaller second rectangular base connected in parallel, the annular securing members extend from the short sides of the second rectangular base along a long side of the second base.

10. The computer panel as described in claim 9, wherein the annular securing members respectively extend beyond two short sides of the first rectangular base, a gap is defined between each of the short sides and an inner side of each annular securing member.

11. The computer panel as described in claim 10, wherein a securing slot is defined between each securing member and each short side of the second rectangular, each elastic hook comprises a cantilever and a clasp bent from a distal end thereof, the clasp extends through the securing slot of the securing member from the gap and engages with an edge of the securing member, for securing the connector in the receiving bracket.

12. A computer panel with a connector assembly, comprising:

a panel comprising an inner surface configured for facing an interior of a computer and an outer surface opposing the inner surface, a through opening being defined from the outer surface to the inner surface, at least one arch protruding from the outer surface of the panel, a slot being defined between an edge of the arch and the panel;

a receiving bracket attached to the outer surface of the panel and covering the opening, the receiving bracket comprising a top wall, a bottom wall, a front wall connected between the top wall and the bottom wall, and a pair of sidewalls extending from opposite ends of the front wall to form a housing between the walls, each of the sidewalls having an elastic hook extending backward therefrom, at least one blocking tab extending from the bottom wall; and a connector fittingly received in the housing and communicating with the interior of the computer via the through opening, the connector comprising a pair of securing members respectively extending from opposite sides thereof, a securing slot being formed between each of the securing members and the corresponding side of the connector;

wherein the blocking tab of the receiving bracket is inserted in the slot of the panel in a direction parallel to the panel and blocked by the arch in another direction perpendicular to the panel, each of the elastic hooks extends through a corresponding securing slot and engages with the corresponding securing member in said another direction.

13. The computer panel as described in claim 12, wherein a securing tab extends from an edge of the top wall opposing the front wall, a pair of aligned securing holes is respectively defined in the securing tab and the panel, and a fastener extends through the securing holes to thereby fasten the receiving bracket to the panel.

14. The computer panel as described in claim 12, wherein the connector comprises a bigger first base and a smaller second base having a plurality of cables extending therefrom and connecting with an inner side of the first base, the smaller second base being received in the opening of the panel and the inner side of the first base abutting against the outer surface of the panel.

15. The computer panel as described in claim 14, wherein a plurality of connector ports are formed at an outer side of the first base opposing the second base, and a plurality of openings is defined in the front wall of the receiving bracket for exposing the connector ports.

16. The computer panel as described in claim 15, wherein the ports are USB ports, audio ports, or video ports.

* * * * *